US010011415B1

(12) United States Patent
Bergeron et al.

(10) Patent No.: US 10,011,415 B1
(45) Date of Patent: Jul. 3, 2018

(54) PACKING TRAY FOR STACK OF HOLLOW CONICAL OBJECTS

(71) Applicant: Tekni-Plex, Inc., Wayne, PA (US)

(72) Inventors: Mark A. Bergeron, Monroe, GA (US); Babu Kuruvilla, Griffin, GA (US)

(73) Assignee: Tekni-Plex, Inc., Wayne, PA (US)

( * ) Notice: Subject to any disclaimer, the term of this patent is extended or adjusted under 35 U.S.C. 154(b) by 49 days.

(21) Appl. No.: 15/373,835

(22) Filed: Dec. 9, 2016

(51) Int. Cl.

| | |
|---|---|
| ***B65D 85/30*** | (2006.01) |
| ***B65D 81/05*** | (2006.01) |
| ***B65D 43/16*** | (2006.01) |
| ***B65D 43/02*** | (2006.01) |
| ***B65D 21/02*** | (2006.01) |
| ***B65D 85/36*** | (2006.01) |
| ***B65D 81/02*** | (2006.01) |

(52) U.S. Cl.
CPC ..... *B65D 81/05* (2013.01); *B65D 21/0212* (2013.01); *B65D 43/02* (2013.01); *B65D 43/16* (2013.01); *B65D 81/025* (2013.01); *B65D 85/36* (2013.01); *B65D 2581/055* (2013.01); *B65D 2585/363* (2013.01)

(58) Field of Classification Search
CPC ..... B65D 2585/363; B65D 75/22; B65D 75/225; B65D 75/24; B65D 81/025; B65D 81/133; B65D 85/36; B65D 85/62
See application file for complete search history.

(56) References Cited

U.S. PATENT DOCUMENTS

| | | | | |
|---|---|---|---|---|
| D164,302 S | | 8/1951 | Harper | |
| 2,843,496 A | | 7/1956 | Altenburg et al. | |
| D183,318 S | | 8/1958 | Martelli | |
| 3,420,395 A | | 9/1966 | Boyd et al. | |
| 3,464,618 A | | 6/1968 | Martelli | |
| 3,853,221 A | | 12/1974 | Boyd | |
| 4,840,276 A | * | 6/1989 | George | B65D 81/025 206/499 |
| D333,093 S | | 2/1993 | Rehrig et al. | |
| D352,893 S | | 11/1994 | Legacy et al. | |
| 6,050,027 A | * | 4/2000 | Pavelka | B65D 75/22 47/84 |
| 6,666,348 B2 | | 12/2003 | Fore | |
| D506,397 S | | 6/2005 | Hall | |
| RE41,054 E | | 12/2009 | Nakagawa | |

(Continued)

FOREIGN PATENT DOCUMENTS

| | | | | |
|---|---|---|---|---|
| CA | 2141478 A1 | * | 8/1996 | B65D 1/26 |
| DE | 4208870 A1 | * | 10/1992 | B25H 3/06 |

*Primary Examiner* — Anthony Stashick
*Assistant Examiner* — Mollie Impink
(74) *Attorney, Agent, or Firm* — Polsinelli PC; Therese A. Hendricks

(57) ABSTRACT

Packing tray for protecting fragile hollow conical objects, such as conical ice cream cones, which allows a stack of such conical objects to be held securely in a pocket of the packing tray, and which allows a plurality of stacked trays and objects to be packaged in cartons. The packing tray is a plastic foam sheet having a top wall and one or more recessed elongated pockets extending downwardly from the top wall, each pocket holding a stack of conical objects. Each pocket includes a floating bottom and flexible and fluted sidewall pleats for dissipating exterior applied forces and snugly engaging a stack of cones held in the pocket, thereby improving product protection, in a relatively low cost and lighter weight construction.

21 Claims, 6 Drawing Sheets

(56) References Cited

U.S. PATENT DOCUMENTS

| | | | |
|---|---|---|---|
| 7,931,148 | B2 | 4/2011 | Hansen |
| D649,460 | S | 11/2011 | Davis |
| D667,305 | S | 9/2012 | Kuhn et al. |
| D719,025 | S | 12/2014 | Ramirez et al. |
| 9,539,757 | B2 | 1/2017 | Ramirez et al. |

* cited by examiner

PACKING TRAY FOR STACK OF HOLLOW CONICAL OBJECTS

FIELD OF THE INVENTION

The present invention relates to a plastic packing tray for holding fragile hollow conical objects, such as ice cream cones, and adapted for stacking multiple such filled trays in a carton.

BACKGROUND OF THE INVENTION

Packing trays having recessed pockets are commonly used to package fragile objects to enable their safe storage, transport and/or display. For example, fragile items such as ice cream cones are typically arranged in a stack disposed in an elongated pocket of a base tray. A second tray, or hinged tray top, may be applied over the base tray, and then multiple such filled trays packaged in a container (such as a carton or box) for shipment. Alternatively, a single tray and cover may be packaged in a box for purchase by an individual consumer. In either case, transport from a manufacturer to a retail outlet, or transport from a retail outlet to the home of an individual consumer, the transport poses significant risks of breakage caused by, e.g., heavy objects being placed on top of the carton, the carton being thrown or dropped, or the carton otherwise encountering impact forces from any side that may crush the package and the enclosed objects. In particular, ice cream cones are relatively brittle and will crack if subject to even moderate pressure. A broken cone is of little use to the consumer or food retailer and is typically discarded.

Thus, there is a need for a packing tray that provides sufficient protection from mechanical forces encountered during packaging, shipment and/or storage so as to avoid damaging the enclosed fragile objects, such as conical ice cream cones or other hollow conical objects.

There is also a need to provide such a packing tray at a lower cost and lighter tray weight to reduce the cost of shipment and/or the cost of manufacturing the tray.

SUMMARY OF THE INVENTION

In accordance with one embodiment of the invention, a packing tray is provided for protecting fragile hollow conical objects, such as conical ice cream cones, which allows a stack of such conical objects to be held securely in a pocket of the packing tray, and which allows a plurality of stacked trays and objects to be packaged in cartons.

The packing tray is a plastic foam sheet having a top wall and one or more recessed elongated pockets extending downwardly from the top wall, each pocket holding a stack of conical objects. Each pocket includes a floating bottom and flexible and fluted sidewall pleats for dissipating exterior applied forces and snugly engaging a stack of cones held in the pocket, thereby improving product protection, in a relatively low cost and lighter weight construction. Typically, several stacks of cones are laid in multiple row pockets and then another tray is flipped over and laid on the bottom filled tray. In this manner, the elongated pockets of the second flipped tray cushion and shield the upper edges of the stack of cones lying above the top wall of the lower tray. A second layer of cones can then be loaded in a third tray and covered with a fourth flipped tray. The number of layers is determined by the depth of the packing carton, wherein stacked layers of two to three covered trays are typically stacked in a single shipping carton.

The tray itself includes various features for protecting the fragile cones. A floating bottom and fluted sidewalls help to relieve stress on the cones, allowing each stack of cones to move downwardly (transverse to the top wall of the tray) and outwardly (parallel to the direction of the top wall), as pressures are applied to the tray or carton. The fluted sidewalls also accommodate for variations in cone diameters. The floating bottom includes two separate floating bottom portions, a lowermost bottom floating pad attached by expandable flutes to a bottom wall of the pocket, and an angled floating pad, disposed between the bottom floating pad and one end of the pocket, and at an acute angle to the top wall, and similarly connected by expandable flutes to an angled bottom wall of the pocket. The outermost cone of the stack rests on the angled floating pad, and preferably voids are provided adjacent each end of the angular floating pad to relieve pressure at both ends (the conical tip and opposing open top end of the outer cone) to prevent breakage thereof. In addition, two or more end bumpers may be positioned, offset from the elongated centerline of the pocket, for engaging the open top end of the innermost cone in the stack, at the opposing end of the pocket (opposite the angled floating pad). Still further, the tray may include a foot support provided substantially around the entire perimeter of the recessed pocket to act both as a support for stacking one flipped tray on top of a lower base tray, and also to act as an additional shock absorber. Still further, long trim flanges may be provided all around the tray to minimize the shock or force transfer from outside edges of the tray or carton to the stack of cones.

In accordance with one embodiment of the invention, a packing tray for conical ice cream cones and other hollow conical objects is provided, the packing tray comprising:

- a plastic foam sheet having a top wall surrounding one or more recessed elongated pockets, the top wall defining a top reference plane (TRP) and the pockets extending downwardly from the TRP;
- each pocket having an elongated axis parallel to the TRP and being configured to hold a stack of nested conical objects between opposing elongated sidewalls, first and second end walls, and a bottom wall;
- each pocket further including: a) a conical portion adjacent the first end wall to accommodate an outer conical object of the stack, the conical portion including an upwardly angled wall, at an acute angle to the TRP, disposed between the bottom wall and the first end wall; and b) a rectilinear portion including the bottom wall and disposed adjacent the second end wall to accommodate the remainder of the stack;
- a bottom floating pad disposed in the rectilinear portion above the bottom wall, the bottom floating pad comprising a bottom platform disposed upwardly of the bottom wall and joined to the bottom wall by a plurality of expandable flutes;
- an angled floating pad disposed in the conical portion above the angled wall, the angled floating pad comprising an angled platform disposed upwardly of the angled wall and joined to the angled wall by a plurality of expandable flutes, wherein a gap is defined between the angled floating pad and bottom floating pad to allow a top open end lip of the outer conical object of the stack to hang freely in the gap between the angled wall and the bottom wall; and
- wherein the expandable flutes flex in response to the weight and dimensions of the stack of conical objects enabling the bottom platform to move with respect to the bottom wall and the angled platform to move with respect to the angled wall is provided.

In one embodiment, the sidewalls have expandable flutes to accommodate movement of the sidewalls with respect to the bottom wall.

In one embodiment, a second gap is defined between the first end wall and the angled floating pad to allow a conical tip end of the outer conical object of the stack to hang freely in the second gap between the angled floating pad and the first end wall.

In one embodiment, the first end wall has a conical shape configured to engage a conical tip end of the outer conical object of the stack.

In one embodiment, one or more bumpers extend into the pocket from the second end wall to space the open top lip end of the innermost conical object from the second end wall.

In one embodiment, the second end wall is disposed at an acute angle to the TRP.

In one embodiment, each pocket has a downwardly extending foot support surrounding the bottom wall and angled wall.

In one embodiment, the foot support comprises a bottom perimeter of the pocket.

In one embodiment, a pair of first and second packing trays is disposed in a vertically stacked arrangement, wherein the foot support of the first packing tray engages the foot support of the second packing tray.

In one embodiment, the peripheral surface includes a planar trim lip around the perimeter of the top wall.

In one embodiment, a pair of first and second packing trays is provided, disposed in a vertically stacked arrangement, wherein the trim lip of the first packing tray engages the trim lip of the second packing tray.

In one embodiment, the tray includes a plurality of elongated pockets in a side-by-side arrangement with their elongated axes in parallel.

In one embodiment, the top wall has a substantially rectangular perimeter and the tray has a plurality of elongated pockets in a side-by-side arrangement with their elongated axes in parallel.

In one embodiment, the tray is unitarily formed from a single foam sheet.

In one embodiment, the plastic foam sheet comprises one or more of polystyrene, polyester, polyolefin, polypropylene, and poly(lactic acid), including homopolymers, copolymers and mixtures thereof, and including virgin and reclaimed materials.

In one embodiment, the plastic sheet comprises polystyrene foam.

In one embodiment, each pocket has a pocket depth, between the bottom wall and top wall, configured to be about half of a diameter of an open top end lip of an outer conical object of the stack.

In another embodiment, a stack is provided comprising:

a set of two packing trays stacked with an upper surface of their top walls in facing engagement with one another;

wherein the elongated pockets of the two trays are configured to form a combined pocket space that engages a perimeter of the stack of conical objects.

In one embodiment, a stack of one or more sets of packing trays is provided, disposed in a box for storage, shipment or display.

In one embodiment, the stack comprises multiple sets of trays, wherein each pocket has a downwardly extending foot support surrounding the bottom wall and angled wall, and adjacent sets are stacked with their foot supports in facing engagement with one another.

In one embodiment, a method of packing conical ice cream cones or other conical objects in a stack is provided comprising:

forming a stack by positioning two packing trays stacked with an upper surface of their top walls in facing engagement with one another;

wherein the elongated pockets of the two trays are configured to form a combined pocket space that engages a perimeter of the stack of conical objects.

These and other advantages of the present invention will be apparent from the following description.

DETAILED DESCRIPTION OF THE INVENTION

FIGS. 1-9 show a packing tray 10 according to one embodiment of the invention. The packing tray 10 is formed from a single sheet of plastic foam, here polystyrene foam, and is particularly well-suited for packing stacks of nested conical ice cream cones or stacks of other nested conical hollow objects. The present embodiment is a non-limiting example of the invention.

Figure 8:
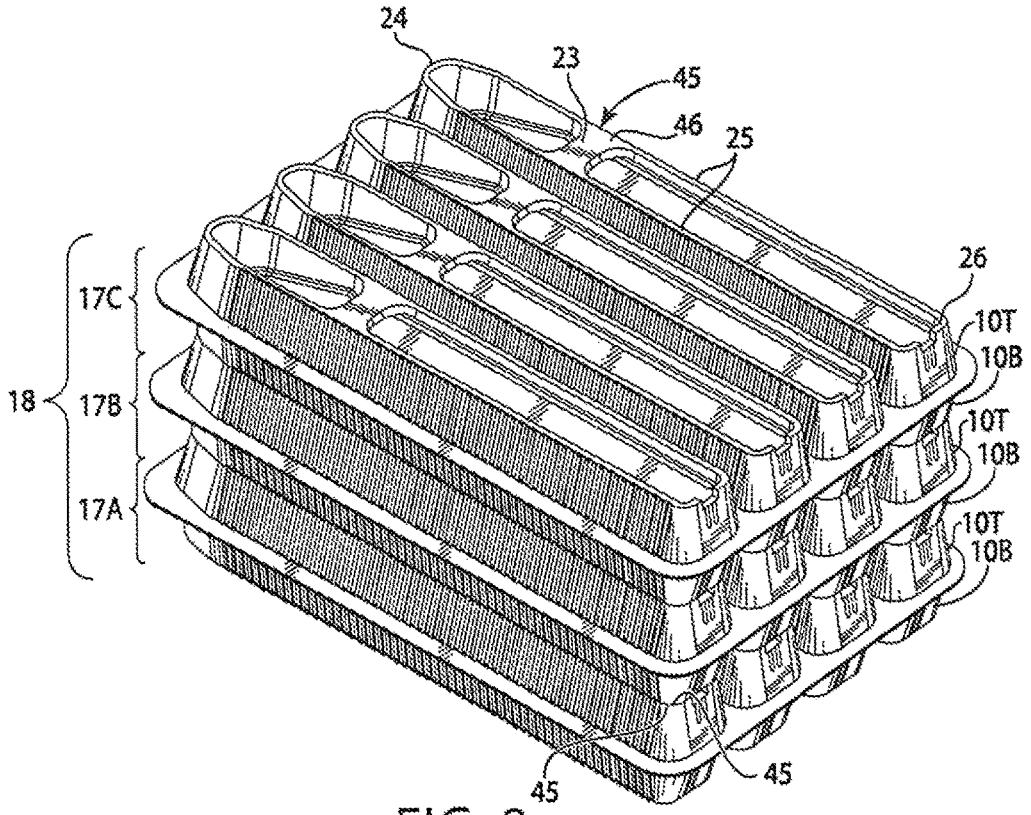
FIG. 8 is a top perspective view of multiple stacked trays for positioning in a carton (as shown in FIG. 9)
Figure 9:
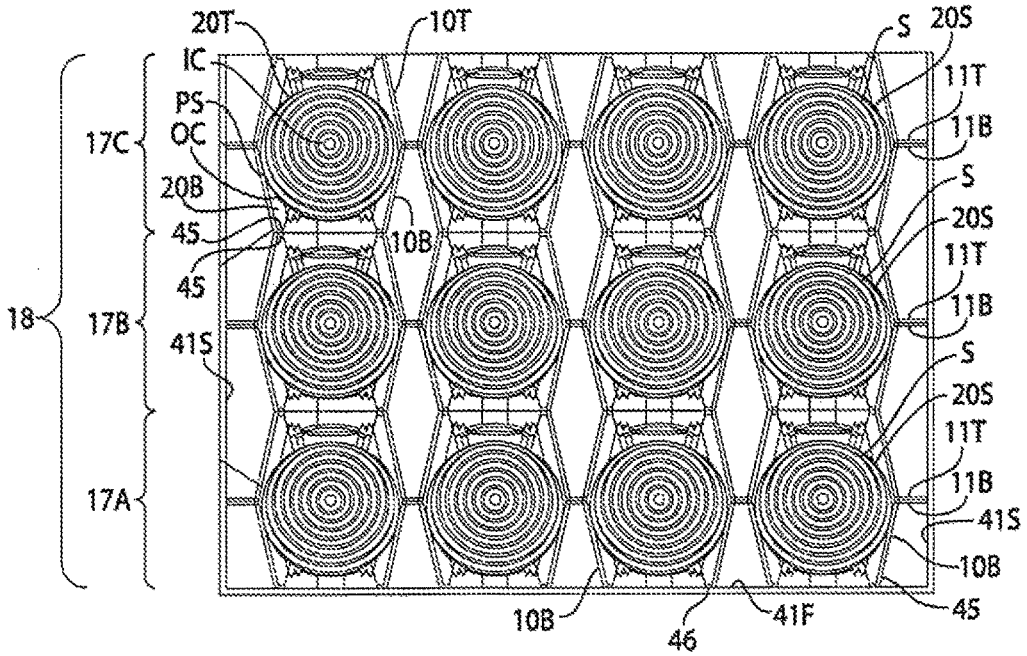
FIG. 9 is a cross sectional view of the stacked trays of FIG. 8 in a carton, showing (across each horizontal row) four stacks of cones disposed in mating lower and upper recessed pockets of a bottom tray and a top tray respectively, the top tray having been flipped over and resting on the bottom tray, and here including three vertically aligned sets of filled bottom and top tray pairs.

FIGS. 1-4 show one tray 10 with empty pockets 20 in perspective and various cross sectional views. FIGS. 5-9 show a bottom tray 10B having pockets 20 each filled with a stack S of nested cones C. FIGS. 8-9 show sets of stacked trays, each set comprising a bottom tray 10B and a top tray 10T in vertically stacked arrangement, collectively holding a stack S of cones C in their combined pocket space 20S.

The top and bottom trays are identical in this embodiment, and are easily stacked as described below for packing in an outer container 40 (FIG. 9).

Figure 2:
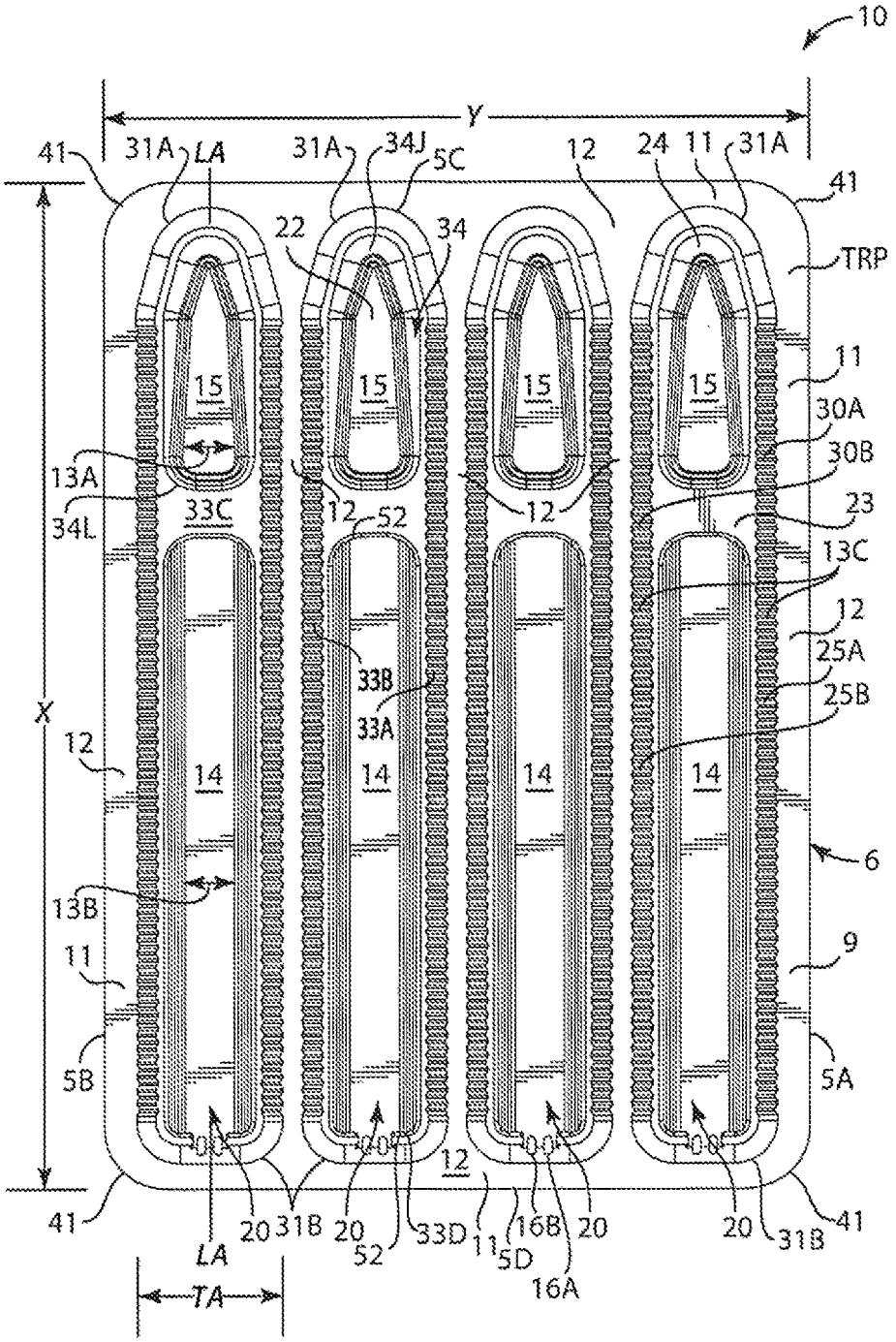
FIG. 2 is a top plan view of the tray of FIG. 1.
Figure 3:
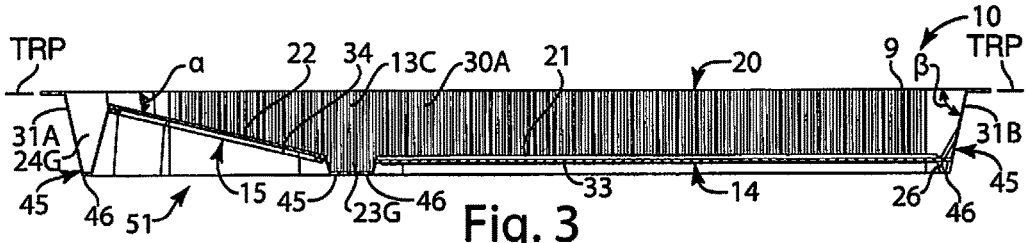
FIG. 3 is a side cross sectional view showing one pocket of the tray of FIG. 1.
Figure 4:
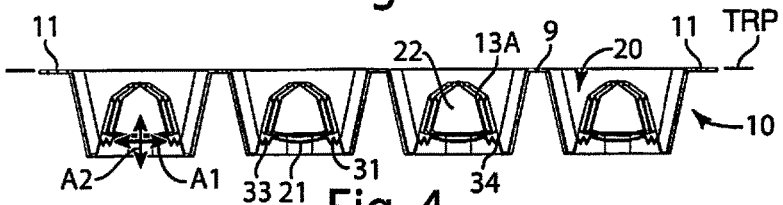
FIG. 4 is a cross sectional end view showing a transverse view of the interior of four pockets of the tray of FIG. 1.
Figure 5:
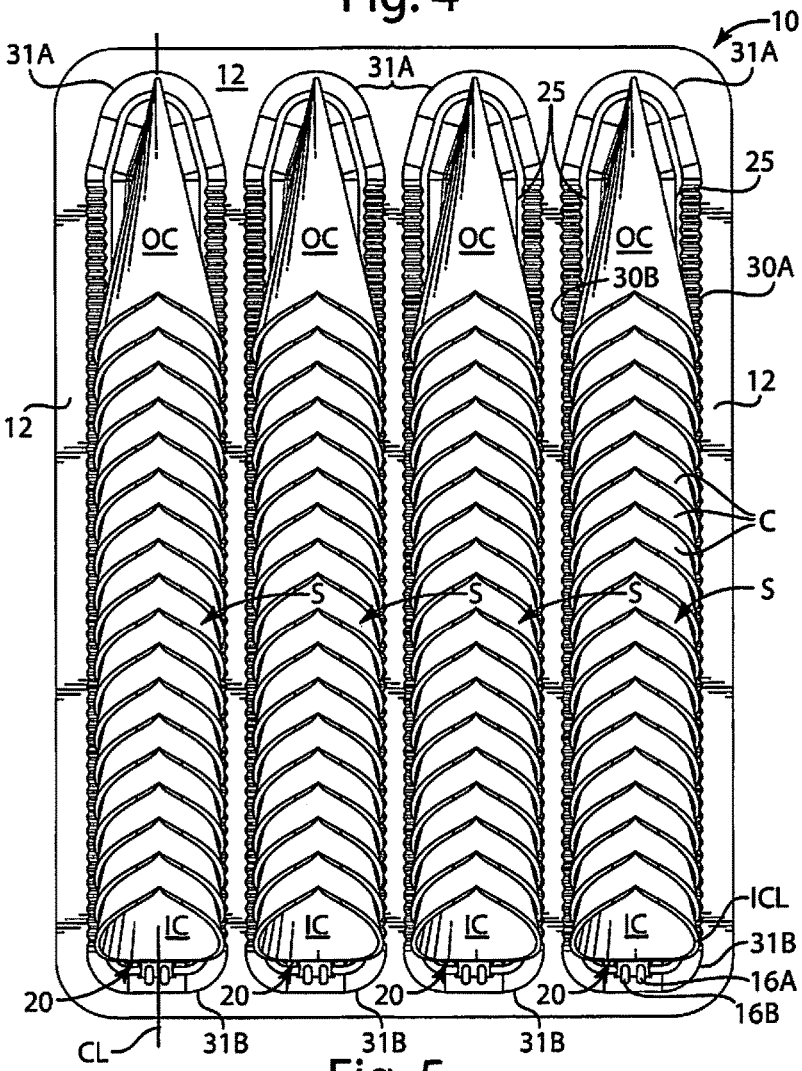
FIG. 5 is a top plan view, similar to FIG. 2, with a stack of conical ice cream cones disposed in each elongated pocket of the tray.
Figure 6:
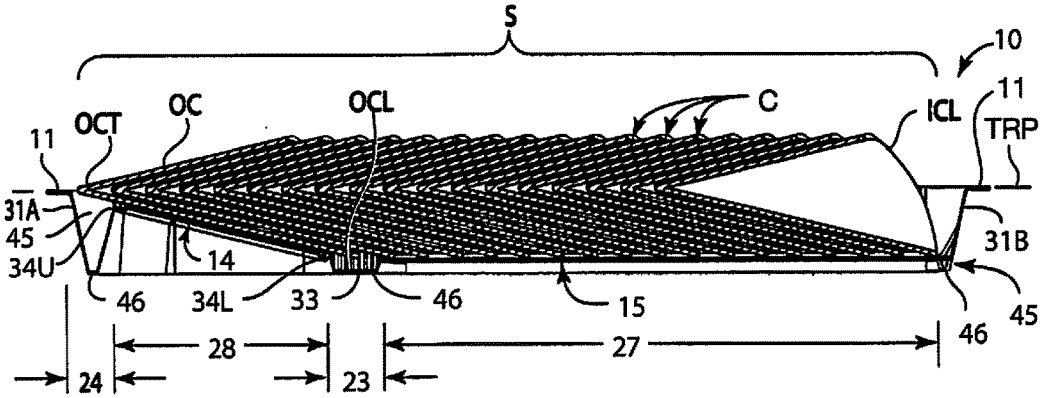
FIG. 6 is a side cross sectional view similar to FIG. 3, but showing a sectional view of the stack of cones in the recessed pocket.
Figure 7:
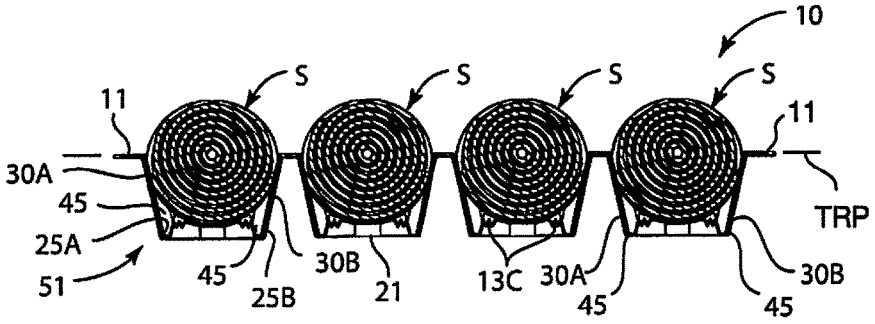
FIG. 7 is a cross sectional end view similar to FIG. 4, but showing a sectional view of the stack of cones in each pocket.

The packing tray 10 has a plurality of recessed elongated pockets 20 depending downwardly from a top wall 9, each pocket formed to accommodate a stack S of nested ice cream cones C to be packed therein (FIGS. 5-7). The tray top wall 9 is generally rectangular shaped with a longitudinal (length) dimension X and a lateral (width) dimension Y, and each pocket has an elongated axis LA aligned parallel to the length direction X of the tray (FIG. 2). The tray perimeter 6 is formed by two opposing longitudinal edges 5A and 5B, and two opposing lateral edges 5C and 5D, joined by four rounded corners 41. The top wall 9 has a top peripheral surface 12 surrounding each of the four elongated pockets 20 and defining a top reference plane TRP (FIGS. 2-7). Here the tray has four elongated pockets, extending downwardly with respect to the TRP, and the pockets are of the same configuration and dimensions.

The top peripheral surface 12 of the tray includes a flat planar trim lip 11 separating the pockets from the perimeter 6 of the top wall 9. The trim lip 11 extends around the entire perimeter 6 and completely circumscribes the array of elongated pockets 20 (FIGS. 1-9). When packed in a container 40 (e.g., for storage and shipment) as shown in FIG. 9, the upper surface of the flat planar trim lip 11B of a bottom tray 10B engages the upper surface of the flat planar trim lip 11T of an adjacent top tray 10T, the top and bottom trays being stacked vertically top to bottom (with the top tray flipped 180 degrees with respect to the bottom tray) to form a closed packing tray set enclosing a stack S of cones C disposed in a combined pocket space 20S formed by the facing pockets 20T and 20B of the top and bottom trays respectively. The trim lip 11 rests between the inner container wall 41 and the elongated pockets 20 (FIG. 9). This enables the trim lip to absorb a portion of any impact on the container such as the normal jostling that occurs during shipping. The trim lip 11 also provides a relatively easily graspable point on the packing tray 10, whether of a single tray or a tray set, by offering parallel grasping points at every point along the perimeter 6 (FIGS. 1-8).

In accordance with the present invention, and as best shown in FIGS. 5-6, a stack S of nested ice cream cones C (or other hollow conical objects in a nested stack) can be fitted into each recessed pocket 20 of the tray, wherein the stack of cones is supported by both a bottom floating pad 14 and an angled floating pad 15 in the pocket 20. The angled floating pad 15 supports an outer cone OC of the stack of cones and the bottom floating pad 14 supports the remainder of the stack (FIG. 5-6). The angled floating pad 15 is adjacent to a first end wall 31A of the pocket and the bottom floating pad 14 is adjacent to an opposed second end wall 31B of the pocket. The pocket is generally rectilinear in shape, wherein the two opposing end walls 31A and 31B are joined by two opposing sidewalls 30A and 30B to form the generally rectilinear shaped (in a plane parallel to the TRP) pocket.

The elongated pocket 20 is further defined as including an elongated portion 27 and a conical portion 28, best shown in FIG. 5. The conical potion 27 is disposed adjacent the first end wall 31A and includes the angled floating pad 15 to support an outer cone OC of the stack. The elongated portion 27 includes the bottom floating pad 14 to support the remaining cones of the stack. A bottom gap (first void space) 23G is defined by a downwardly recessed wall portion 23 between the angled floating pad 15 and the bottom floating pad 14, allowing the open top lip OCL of the outer cone of the stack to hang freely between the two pads (FIG. 5). At the other tip end of the outer cone, a first end wall gap 24G is defined by a downwardly recessed wall portion 24 between the first end wall 31A and the angled floating pad 15 to provide a second void space for the outer cone tip OCT to hang in this second (first end wall) gap 24G. These two gaps 23G and 24G, at either end of the angled floating pad 15, provide protection for both ends of the outermost cone, this being the cone generally subject to the greatest applied forces.

Another feature of the tray is a foot support 45, best seen in FIGS. 3-4 and 6-9. The foot support provides a flat planar lowermost surface 46 for resting the tray on a flat surface (e.g. in the bottom of a carton or on a tabletop), as well as providing a flat planar mating surface for an adjacent stacked tray as shown in FIGS. 8-9. In this embodiment, the foot support 45 is a lowermost extending wall portion of the tray, including footer wall portions 25 forming sidewall gaps 25G adjacent each of the pocket sidewalls 30A and 30B (see FIGS. 1-2 and 8) that separate the sidewalls from both the angled floating pad 15 and the bottom floating pad 14, allowing the pads 14,15 to move transversely with respect to the sidewalls 30. The foot support 45 (lowermost surface of the tray) further includes wall portions 23 and 24 (previously described) below the bottom gap 23G and first end wall gap 24G, as well as a second end wall footer 26 (adjacent the second end wall 31B), to form a perimeter footing 45 circumscribing the X-Y profile of each pocket 20 (FIG. 8). The footing 45 provides a stable support structure for the pockets 20 and a contact mating surface 46 for adjacent trays of a stack 18 of trays (FIGS. 8-9). The footing 45 further enables movement between adjacent trays to dissipate applied forces between the trays. For example, where the footing 45 of two trays are aligned between an upwardly facing tray 47 and a downwardly facing tray 48 (FIGS. 8-9), forces are translated between the trays through the footing 45 of each and then on into the pocket sidewalls 30 rather than directly into the cones.

The pocket sidewalls 30A and 30B also have expandable (accordion-like) flutes 13C aligned transversely to the TRP that allow the sidewalls to expand and move in various directions in response to applied forces, and to accommodate varying cone diameters.

Figure 1:
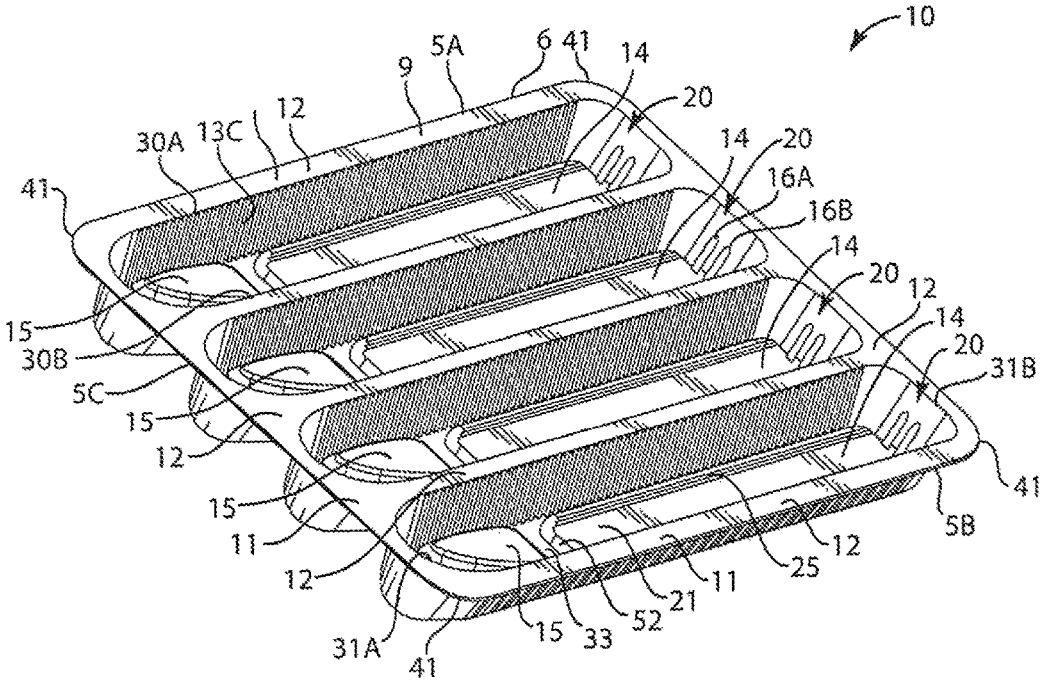
FIG. 1 is top perspective view of a packing tray having four parallel elongated recessed pockets, each pocket for holding a stack of hollow conical objects, such as conical ice cream cones, according to one embodiment of the invention.

The bottom floating pad 14 comprises a bottom platform 21 connected by expandable (accordion-like) bottom flutes 13B to the bottom wall 33. In a relaxed state, when the pocket is empty, the bottom platform 21 is disposed above the bottom wall 33. When cones are added to the pocket, the bottom flutes 13B allow the bottom platform 21 to move downwardly toward the bottom wall 33, away from the TRP. Bottom wall 33 has four sides, two opposing elongated sides 33A and 33B running parallel to the elongated axis LA of the pocket, and two opposing short sides 33C and 33D running parallel to a transverse axis TA of the pocket (FIG. 2). The bottom flutes 13B are aligned parallel to the elongated axis LA and join the long sides 33A and 33B of the bottom wall 33 to the bottom platform; the short sides 33C and 33D of the bottom wall are joined to the bottom platform by a non-fluted connecting member 52 (FIGS. 1-2). The long sides 33A and 33B connect to the pocket sidewalls 30 and form the sidewall gaps 25G along each sidewall 30A and 30B as previously described (FIG. 2). This enables the bottom platform 21 to move both along the transverse axis TA, as well as up and down (transverse to TRP) as the bottom flutes 13B expand and contract (FIG. 4, arrows A1 and A2).

The angled floating pad 15 comprises an angled platform 22 connected by expandable (accordion-like) flutes 13A to an angled wall 34. The upwardly angled wall 34 is disposed at an acute angle a to the TRP (see FIG. 3) and forms the generally conical cross section (of the conical pocket portion 28) between the first end wall 31A and the bottom wall 33 (FIG. 6). The bottom gap 23G separates a lowermost end wall 34L of the angled wall 34 from the bottom wall 33. The first end wall gap 24G separates an uppermost end 34U of the angled wall form the first end wall 31A. The angled platform 22 is circumscribed by the angled wall 34 and positioned above the angled wall(in a relaxed state, pocket empty) by the circumferential flutes 13A. The flutes join the angled platform 22 to the angled wall 34 and are aligned generally parallel to the TRP (FIG. 3). The angled platform can move along all axes relative to the angled wall (FIGS. 2-3 and/or 9—add arrows to show movement). This complete range of movement allows the angled platform 22 to shift to accommodate a multitude of cone lengths and widths. The mobility of the angled platform 22 and the bottom platform 21 combined with the expanding sidewalls 30A and 30B allows the pocket sidewalls 20 and platforms 22, 21 to move in response to applied forces (e.g., jostling during transport), dissipating the forces across the tray surfaces rather than transmitting the forces to the cone stack.

A pair of bumpers 16A and 16B protrude inwardly from the second end wall 31B and into the pocket recess (FIGS. 1-2 and 5). Each bumper extends from the bottom wall 33 approximately halfway up (moving toward the TRP) the end wall 31B. The bumpers are aligned parallel to one another and disposed on either side of the elongated center axis LA of the pocket 20. The end wall 31B is at an acute angle β to the TRP (FIG. 3). The innermost cone IC of a stack of cones (disposed in the elongated pocket 20) rests with its open top end lip ICL against (or in near proximity to) the bumpers (FIG. 4). The bumpers 16A and 16B help absorb the impact of any movement of the stack of cones along the elongated axis LA of the pocket by compression of the foam tray material, or otherwise deflecting such movement.

FIG. 8 illustrates a stack 18 comprising three sets 17A, 17B, 17C of packing trays, and FIG. 9 shows the stack of three sets disposed in carton 40. A set 17 consists of two packing trays 20 stacked vertically one on top of the other, but with the top tray flipped 180 degrees with respect to the bottom tray so that their open pockets align and form a combined pocket space PS. More specifically, the bottom tray 10B of the set is an upwardly facing packing tray and the top tray 10T of the set is a downwardly facing tray. The top tray is rotated 180 degrees about the TRP so that the pockets 20B and 20T of the two trays combine to form a bounded pocket space PS accommodating a nested stack S of cones C (FIG. 9). Here the depth (transverse to TRP) of each pocket 20B and 20T is one half of the open top end cone diameter, so that the innermost cone IC is held snugly in the pocket about its widest circumference. The packing sets 17 are placed in a vertical stack 18 (e.g., for shipping or storage) by placing one set on top of another, with the tray footings 45 of adjacent sets in mating planar engagement (FIGS. 8-9). This configuration allows a stack of trays 18 to take advantage of the force dissipative construction of the tray walls as described above. When shipped, a stack 18 of trays are placed within a shipping container 40 such that the trim lip 11 of each tray 10 will buffer the tray pockets 20 from the container sidewalls 41S, absorbing any lateral jostling during shipping. The footing 45 of the bottommost tray 10B then contacts the container floor 41F, allowing any impacts through the floor of the container to be translated up through the footing 45 and dissipated into the tray walls as described earlier.

Figure 10:
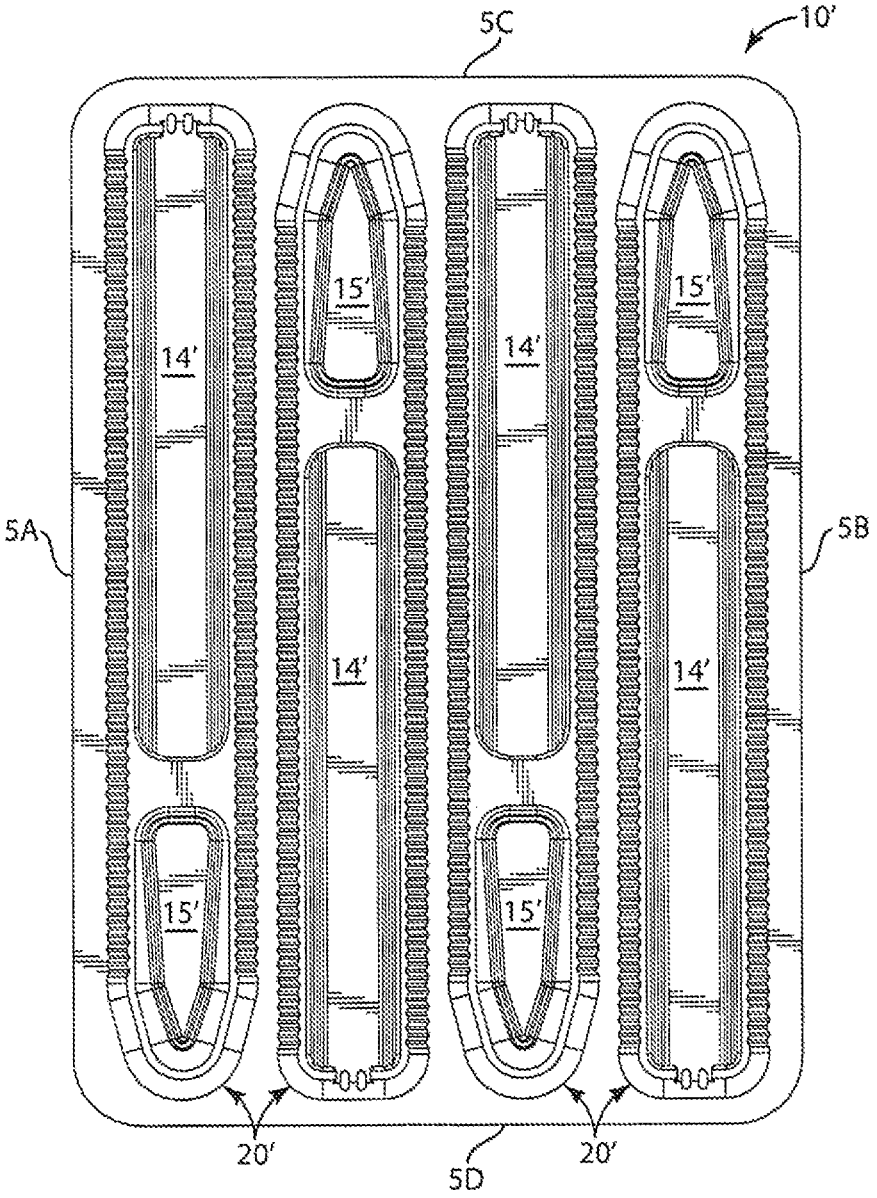
FIG. 10 is a top plan view of an alternative embodiment of a packing tray, having an angled floating pad disposed adjacent opposite ends of the tray in each adjacent pocket of the tray.

FIG. 10 is a top plan view of an alternative embodiment of a packing tray 10', having four pockets 20' in a row and of the same dimensions as FIG. 1, but with the angled floating pad 15' disposed adjacent opposite ends 5C' and 5D' of the tray in each adjacent pocket 20' of the tray.

Variations of the forgoing embodiments will be apparent to the skilled person and are included in the disclosure and claims.

What is claimed is:

1. A packing tray for conical ice cream cones and other hollow conical objects, the packing tray comprising:

a plastic foam sheet having a top wall surrounding one or more recessed elongated pockets, the top wall defining a top reference plane (TRP) and the pockets extending downwardly from the TRP;

each pocket having an elongated axis parallel to the TRP and being configured to hold a stack of nested conical objects between opposing elongated sidewalls, first and second end walls, and a bottom wall;

each pocket further including: a) a conical portion adjacent the first end wall to accommodate an outer conical object of the stack, the conical portion including an upwardly angled wall, at an acute angle to the TRP, disposed between the bottom wall and the first end wall; and b) a rectilinear portion including the bottom wall and disposed adjacent the second end wall to accommodate the remainder of the stack;

a bottom floating pad disposed in the rectilinear portion above the bottom wall, the bottom floating pad comprising a bottom platform disposed upwardly of the bottom wall and joined to the bottom wall by a plurality of expandable flutes;

an angled floating pad disposed in the conical portion above the angled wall, the angled floating pad comprising an angled platform disposed upwardly of the angled wall and joined to the angled wall by a plurality of expandable flutes, wherein a gap is defined between the angled floating pad and bottom floating pad to allow a top open end lip of the outer conical object of the stack to hang freely in the gap between the angled wall and the bottom wall; and wherein the expandable flutes flex in response to the weight and dimensions of the stack of conical objects enabling the bottom platform to move with respect to the bottom wall and the angled platform to move with respect to the angled wall.

2. The packing tray of claim 1, wherein the sidewalls have expandable flutes to accommodate movement of the sidewalls with respect to the bottom wall.

3. The packing tray of claim 1, wherein a second gap is defined between the first end wall and the angled floating pad to allow a conical tip end of the outer conical object of the stack to hang freely in the second gap between the angled floating pad and the first end wall.

4. The packing tray of claim 1, wherein the first end wall has a conical shape configured to engage a conical tip end of the outer conical object of the stack.

5. The packing tray of claim 1, wherein one or more bumpers extend into the pocket from the second end wall to space the open top lip end of the innermost conical object from the second end wall.

6. The packing tray of claim 1, wherein the second end wall is disposed at an acute angle to the TRP.

7. The packing tray of claim 1, wherein each pocket has a downwardly extending foot support surrounding the bottom wall and angled wall.

8. The packing tray of claim 7, wherein the foot support comprises a bottom perimeter of the pocket.

9. A pair of first and second packing trays according to claim 8, disposed in a vertically stacked arrangement, wherein the foot support of the first packing tray engages the foot support of the second packing tray.

10. The packing tray of claim 1, wherein the peripheral surface includes a planar trim lip around the perimeter of the top wall.

11. A pair of first and second packing trays according to claim 10, disposed in a vertically stacked arrangement, wherein the trim lip of the first packing tray engages the trim lip of the second packing tray.

12. The packing tray of claim 1, wherein the tray includes a plurality of elongated pockets in a side-by-side arrangement with their elongated axes in parallel.

13. The packing tray of claim 1, wherein the top wall has a substantially rectangular perimeter and the tray has a plurality of elongated pockets in a side-by-side arrangement with their elongated axes in parallel.

14. The packing tray of claim 1, wherein the tray is unitarily formed from a single foam sheet.

15. The packing tray of claim 1, wherein the plastic foam sheet comprises one or more of polystyrene, polyester, polyolefin, polypropylene, and poly(lactic acid), including homopolymers, co-polymers and mixtures thereof, and including virgin and reclaimed materials.

16. The packing tray of claim 15, wherein the plastic sheet comprises polystyrene foam.

17. The packing tray of claim 1, wherein each pocket has a pocket depth, between the bottom wall and top wall, configured to be about half of a diameter of an open top end lip of an outer conical object of the stack.

18. A stack comprising:

a set of two packing trays of claim 1 stacked with an upper surface of their top walls in facing engagement with one another;

wherein the elongated pockets of the two trays are configured to form a combined pocket space that engages a perimeter of the stack of conical objects.

19. The stack of one or more sets of packing trays of claim 18, disposed in a box for storage, shipment or display.

20. The stack of claim 18, comprising multiple sets of packing trays, wherein each pocket has a downwardly extending foot support surrounding the bottom wall and angled wall, and adjacent sets are stacked with their foot supports in facing engagement with one another.

21. A method of packing conical ice cream cones or other conical objects in a stack comprising:

forming a stack by positioning two packing trays of claim 1 stacked with an upper surface of their top walls in facing engagement with one another;

wherein the elongated pockets of the two trays are configured to form a combined pocket space that engages a perimeter of the stack of conical objects.

* * * * *